US010076837B2

(12) United States Patent
Finck

(10) Patent No.: US 10,076,837 B2
(45) Date of Patent: Sep. 18, 2018

(54) HOLSTER DEVICE

(71) Applicant: Gerald E. Finck, Bellmore, NY (US)

(72) Inventor: Gerald E. Finck, Bellmore, NY (US)

( * ) Notice: Subject to any disclaimer, the term of this patent is extended or adjusted under 35 U.S.C. 154(b) by 0 days.

(21) Appl. No.: 15/002,660

(22) Filed: Jan. 21, 2016

(65) Prior Publication Data

US 2017/0208927 A1 Jul. 27, 2017

(51) Int. Cl.

| | |
|---|---|
| ***A45C 1/04*** | (2006.01) |
| ***A45F 3/00*** | (2006.01) |
| ***F41C 33/02*** | (2006.01) |
| ***B25H 3/00*** | (2006.01) |
| *A45F 5/00* | (2006.01) |

(52) U.S. Cl.

CPC ..... *B25H 3/006* (2013.01); *A45F 5/00* (2013.01); *A45F 2005/006* (2013.01); *A45F 2005/008* (2013.01); *A45F 2200/0575* (2013.01)

(58) Field of Classification Search

CPC ..... A45F 5/14
USPC ..... 220/743, 485, 491; 206/202, 513
See application file for complete search history.

(56) References Cited

U.S. PATENT DOCUMENTS

| | | | | |
|---|---|---|---|---|
| 4,457,462 A * | 7/1984 | Taormina | B25H 3/00 | 224/269 |
| 4,645,104 A * | 2/1987 | Vokaty | A45F 5/02 | 224/673 |
| D306,521 S * | 3/1990 | Kenney | D3/215 | |
| 5,176,302 A * | 1/1993 | Smith | A45F 5/02 | 224/667 |
| 5,195,667 A * | 3/1993 | Gallant | A45F 5/02 | 224/197 |
| 5,248,072 A * | 9/1993 | Jones | A45F 5/14 | 224/247 |
| 6,237,822 B1 * | 5/2001 | Vidal | A45F 5/14 | 224/234 |
| 7,000,809 B1 * | 2/2006 | Stroud | A45F 5/02 | 224/250 |
| 7,077,303 B2 * | 7/2006 | Zega | A45F 5/00 | 224/242 |
| 7,195,140 B1 * | 3/2007 | Marinelli | A45F 5/00 | 224/222 |

* cited by examiner

*Primary Examiner* — Derek Battisti
(74) *Attorney, Agent, or Firm* — Scully, Scott, Murphy & Presser, P.C.

(57) ABSTRACT

The present disclosure is directed to a holster device. The holster device includes an arcuate shaft, a first end of the arcuate shaft connected to a first end of a cradle, a second end of the arcuate shaft connected to a handle support and a central portion of the arcuate shaft formed between the first end of the arcuate shaft and the second end of the arcuate shaft, the cradle configured to contact a tool in a central portion of the cradle, wherein a central portion of the cradle is at an angle that is substantially perpendicular to the first end of the arcuate shaft and the handle support configured to contact the tool in a central portion of the handle support, wherein a central portion of the handle support is at an angle that is substantially perpendicular to the central portion of the arcuate shaft.

7 Claims, 10 Drawing Sheets

HOLSTER DEVICE

BACKGROUND OF THE DISCLOSURE

Holster devices for tools, such as hammers, have several drawbacks, such as making the tool difficult to remove from the holster and making re-storage of the tool in the holster difficult after use.

Therefore, what is desired is a holster that can be worn, that makes removal of a tool and storage of the tool more effective. Embodiments of the present disclosure provide devices and methods that address the above and other issues.

SUMMARY OF THE DISCLOSURE

The present disclosure is directed to a holster device. The holster device includes an arcuate shaft, a first end of the arcuate shaft connected to a first end of a cradle, a second end of the arcuate shaft connected to a handle support and a central portion of the arcuate shaft formed between the first end of the arcuate shaft and the second end of the arcuate shaft, the cradle configured to contact a tool in a central portion of the cradle, wherein a central portion of the cradle is at an angle that is substantially perpendicular to the first end of the arcuate shaft and the handle support configured to contact the tool in a central portion of the handle support, wherein a central portion of the handle support is at an angle that is substantially perpendicular to the central portion of the arcuate shaft.

BRIEF DESCRIPTION OF THE DRAWINGS

The present disclosure will be better understood by reference to the following drawings of which.

DETAILED DESCRIPTION OF THE DISCLOSURE

As used herein, the term "substantially", or "substantial", is equally applicable when used in a negative connotation to refer to the complete or near complete lack of an action, characteristic, property, state, structure, item, or result. For example, a surface that is "substantially" flat would either completely flat, or so nearly flat that the effect would be the same as if it were completely flat.

As used herein, the term "about" indicates that the value listed may be somewhat altered, as long as the alteration does not result in nonconformance of the process or structure to the illustrated embodiment. For example, for some elements the term "about" can refer to a variation of ±0.1%, for other elements, the term "about" can refer to a variation of ±1% or ±10%, or any point therein.

Figure 1:
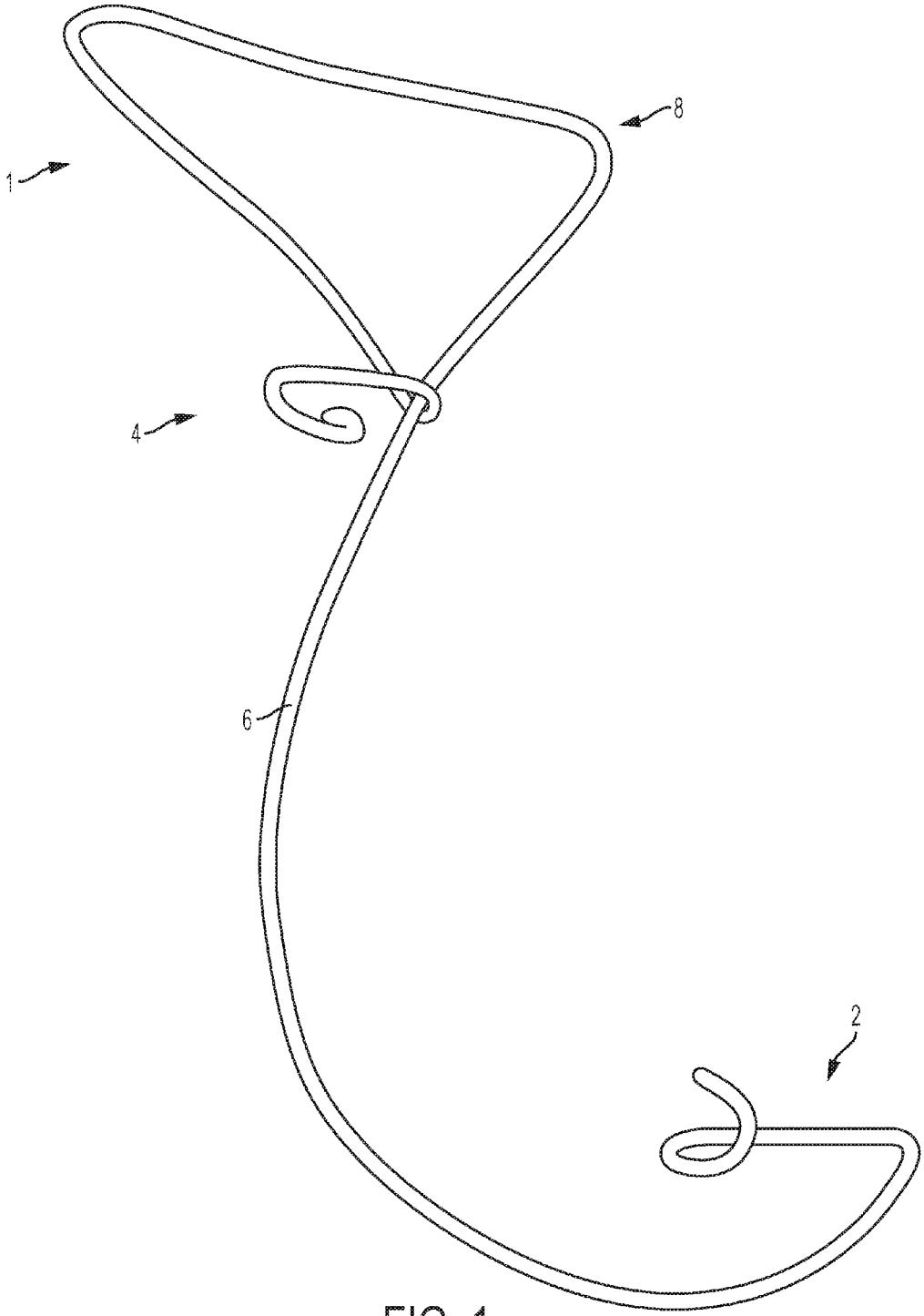
FIG. 1 is a perspective view of a first embodiment of a holster device.

This disclosure includes a holding or holster device 1, as shown in FIG. 1. As discussed herein, device 1 will be referred to as a holster device.

The holster device 1 includes a cradle 2 configured to hold a head of a substantially T-shaped piece of equipment (not shown) and a handle support 4 configured to hold a handle of the T-shaped piece of equipment. An arcuate shaft 6 connects the cradle 2 to the handle support 4. As shown in FIG. 1, a first end of the arcuate shaft 6 is connected to the cradle 2 and a second end of the arcuate shaft 6 is connected to the handle support 4.

Also attached to handle support 4 is an attachment portion 8. Although attachment portion 8 is shown as being substantially triangular in FIG. 1, attachment portion can be in any suitable shape that allows for holster device 1 to be connected to a strap or belt of a user. The holster device 1 is configured to be worn by a user with use of attachment portion 8. This configuration is further discussed below.

Although FIG. 1 illustrates cradle 2, handle support 4, arcuate shaft 6 and attachment portion 8 all being of a single piece of material, in other embodiments, holster device 1 can be formed of several pieces of material that are joined together. The material of holster device 1 can be any material suitable to be formed into the shape shown in FIG. 1, such as one or more of metals like steel, plastics, woods, ceramics, carbon based materials such as carbon fiber and various rubber or resin based materials. In one example, holster device 1 can be formed of 3/16" tempered steel rod that may or may not be chrome plated.

Also, the diameter of each of the portions of device 1 can be the same or it can vary in diameter from location to location. Further, the cross sectional area of each of the portions of device 1 can be any suitable shape, including for example, without limitation, substantially circular, substantially rectangular, substantially triangular, substantially pentagonal and substantially elliptical.

Figure 2:
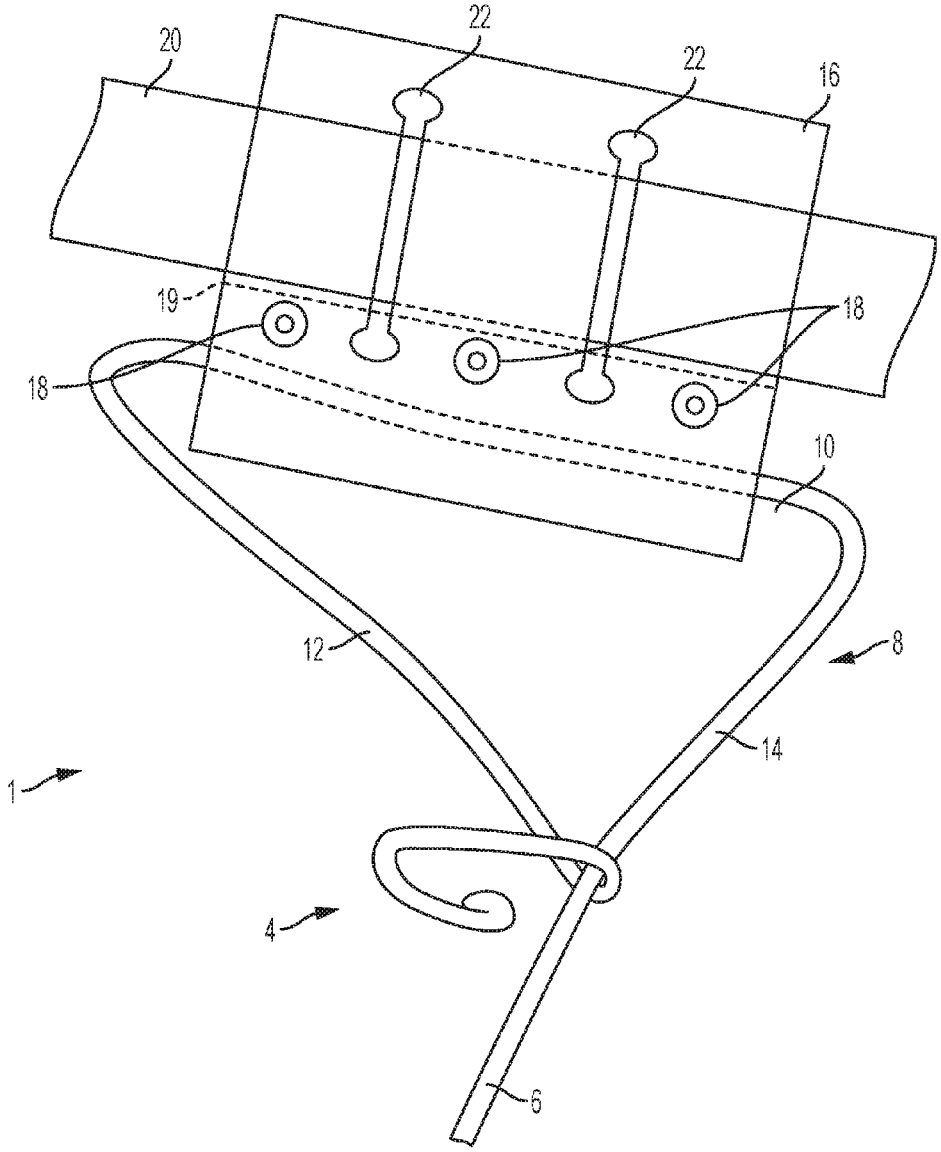
FIG. 2 is a perspective view of an attachment portion of the holster device.

A more detailed view of attachment portion 8 is shown in FIG. 2. As can be seen from FIG. 2, in this embodiment, attachment portion 8 includes a first attachment portion side member 10, a second attachment portion side member 12 and a third attachment portion side member 14.

A securing element 16 is shown as securing the first attachment portion side member 10 with rivets 18. Rivets 18 penetrate the front, visible layer of securing element 16, as well as a folded layer 19, such that the first attachment portion side member 10 is between the layers. Securing element 16 is used to secure holster device 1 to a user, and in this embodiment, a user's belt 20, which passes through two slits 22 in securing element 16.

Securing element 16 can be any suitable material, such as one or more of metals like steel, plastics, woods, ceramics, carbon based materials such as carbon fiber and various rubber or resin based materials. Although securing element 16 is shown as substantially rectangular in FIG. 2, securing element can be any other suitable shape that allows for the securing of holster device 1 to a user, such as substantially circular, substantially triangular, substantially pentagonal and substantially elliptical. Further, although securing element 16 is shown as include two slits 22 to secure holster device 1 to a user, any suitable element can be included for securing holster device 1 to a user, such as one or more clasps, buttons, hooks, fasteners, clips, zippers, straps, ties and ratchet systems.

Figure 3:
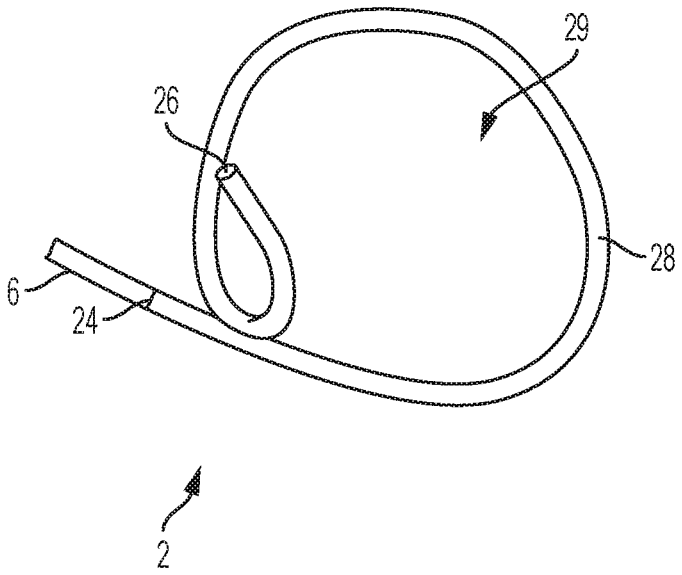
FIG. 3 is a perspective view of a cradle of the holster device.

FIG. 3 illustrates a top view of cradle 2 and a portion of arcuate shaft 6 where arcuate shaft 6 attaches to a first end of cradle 24. First end 24 is shown as an arbitrary line differentiating between cradle 2 and arcuate shaft 6, but in other embodiments the location of the line indicating first end 24 can be at a different location along the length of arcuate shaft 6 or cradle 2.

Cradle 2 terminates at a second end of cradle 26. A central portion of cradle 28, which spans the distance between first end 24 and second end 26 is shown as substantially circular but includes varying radii of curvature as illustrated. An open area formed by a cradle opening 29 is of a suitable size to accept a portion of the head of a T-shaped tool, such as a hammer. The cradle opening 29 is of a suitable size to allow for a portion of the T-shaped tool to pass therethrough and rest on at least one point of the central portion 28.

Figure 4:
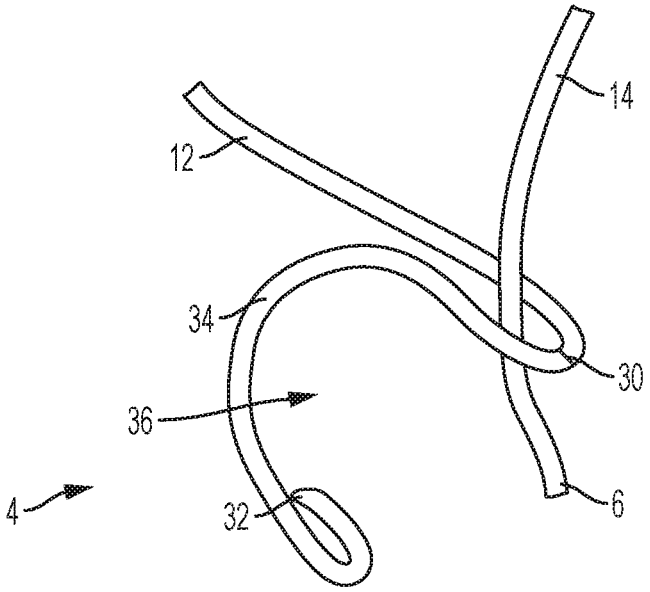
FIG. 4 is a perspective view of a handle support of the holster device.

FIG. 4 illustrates a top view of handle support 4, a portion of the arcuate shaft 6, a portion of the third attachment portion side member 14 and a first end of handle support 30 where handle support 4 attaches to the second attachment portion side member 12. First end 30 is shown as an arbitrary line differentiating between handle support 4 and second attachment portion side member 12, but in other embodiments the location of the line indicating first end 30 can be at a different location along the length of second attachment portion side member 12 or handle support 4.

Handle support 4 terminates at a second end of handle support 32. A central portion of handle support 34, which spans the distance between first end 30 and second end 32 is shown as substantially circular but includes varying radii of curvature as illustrated. An open area formed by handle support opening 36 is of a suitable size to accept a portion of a handle of a T-shaped tool, such as a hammer. The handle support opening 36 is of a suitable size to allow for a portion of a handle of a T-shaped tool to pass therethrough and rest on at least one point of the central portion 34.

Although second end 32 is shown as curled towards central portion 34, in other embodiments, second end 32 can terminate along the same arc as central portion 34, without curling.

Figure 5:
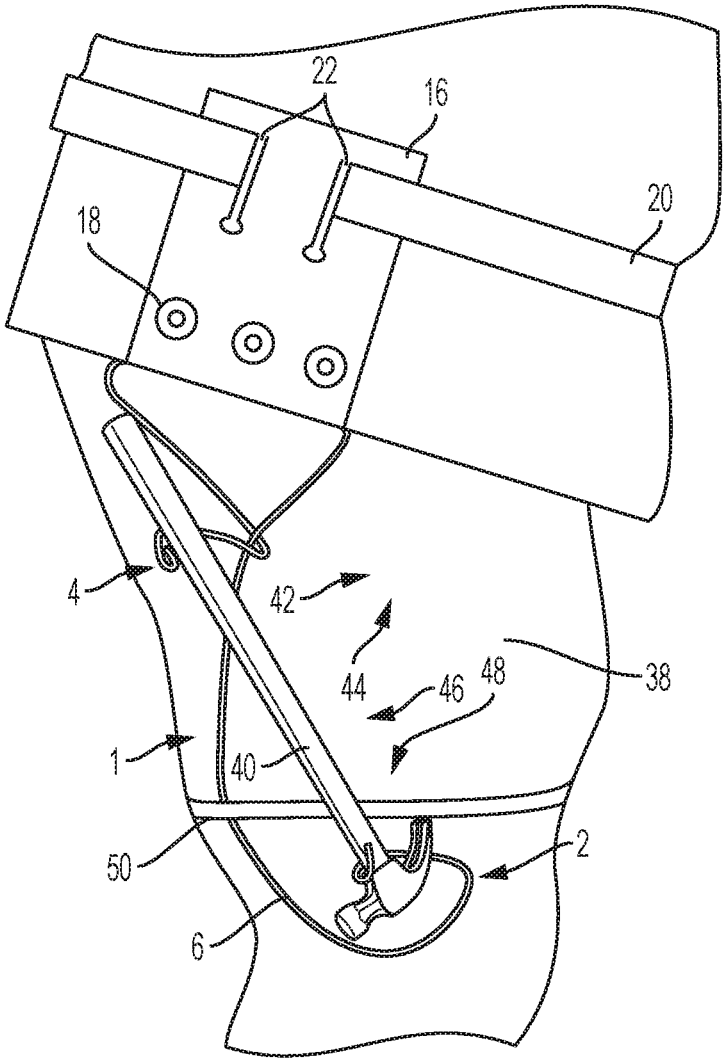
FIG. 5 is a perspective view of the holster device, including a tool, during use.

FIG. 5 illustrates one embodiment of the holster device 1 in use by a user 38. As can be seen from FIG. 5, belt 20 extends around the users 38's waist and a T-shaped tool 40, in this embodiment a claw hammer, is contained within holster device 1. Although holster device 1 is shown as being placed on the user 38's right leg, in other embodiments, holster device 1 can be placed on user 38's left leg.

Tool 40 is contained within holster device 1 by contacting holster device 1 in two locations, handle support 4 and cradle 2. The handle of tool 40 is in contact with central portion 34 (shown in detail in FIG. 4), and a portion of the handle of tool 40 is within opening 36 (shown in detail in FIG. 4). Another portion of the handle or the head of tool 40, depending on the exact structure and configuration of tool 40, is in contact with central portion 28 (shown in detail in FIG. 3) at at least one location and is within opening 29 (shown in detail in FIG. 3).

The structure of holster device 1 allows for the user to grasp the handle of tool 40 and remove it from the holster device 1 along a direction substantially similar to arrow 42, or along a direction substantially similar to arrow 44. Conversely, the structure of holster device 1 allows for the user to place tool 40 within holster device 1 along a direction substantially similar to arrow 46, or along a direction substantially similar to arrow 48.

Also illustrated in FIG. 5 is an optional strap 50 that substantially maintains holster device 1 relatively fixed as compared to the user 38's leg. Strap 50 can be tied, clipped or otherwise attached to holster device 1. Strap 50 can also apply pressure on holster device 1 towards user 38's leg without being attached to holster device 1.

Figure 6:
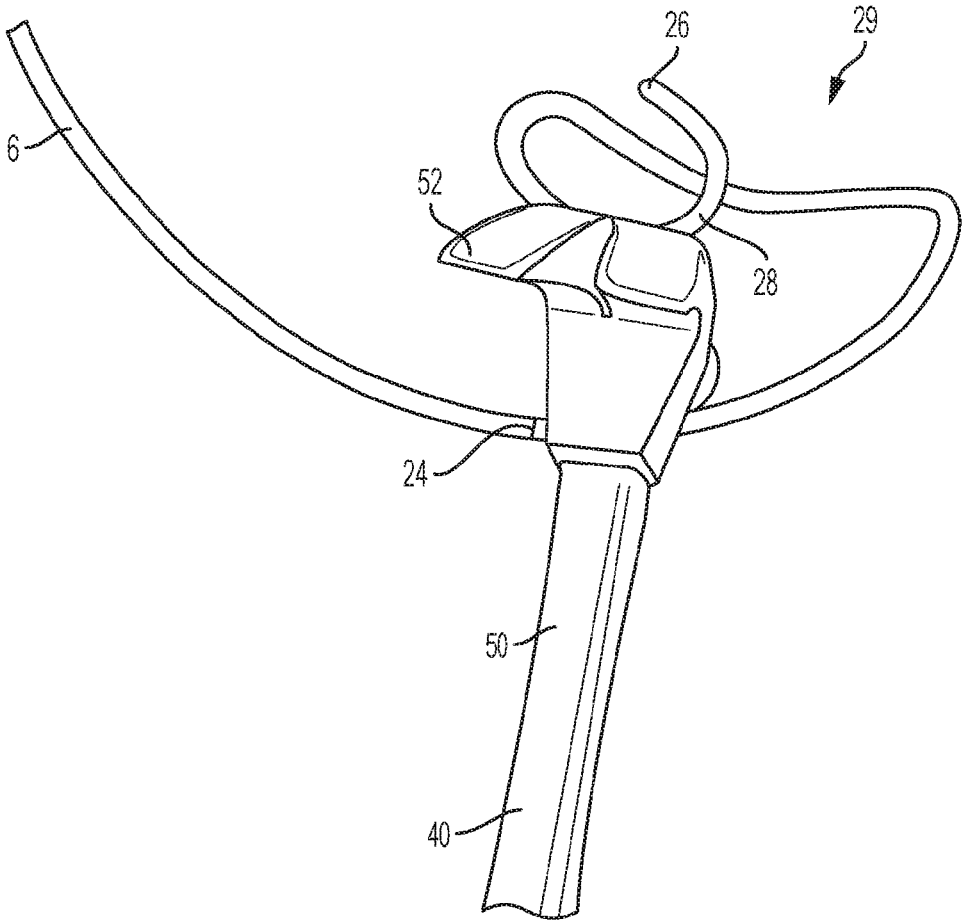
FIG. 6 is a perspective view of the cradle of the holster device, including a tool.

FIG. 6 is a detailed view of the cradle 2 of holster device 1, with tool 40 being maintained in a different configuration as compared to the configuration illustrated in FIG. 5. As shown in FIG. 6, tool 40 includes a handle 50 and a head 52. In this view, handle 50 is not held in handle support 4 intentionally, or if handle 50 is impacted and caused to exit handle support opening 36, tool 40 car rotate about head 52 from the configuration shown in FIG. 5 to arrive at the configuration shown in FIG. 6. Therefore, tool 40 can remain within holster device 1 without falling to the floor.

Figure 7:
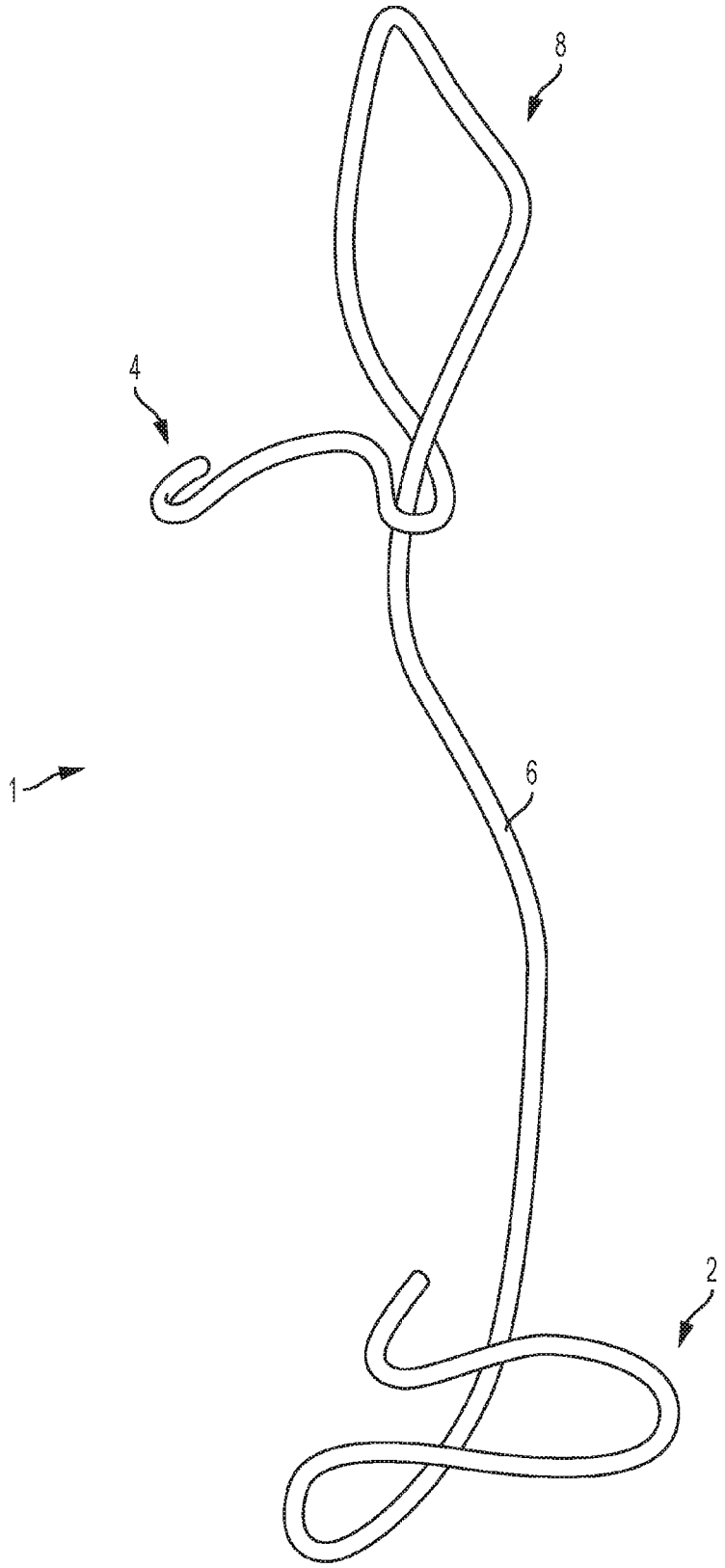
FIG. 7 is a front view of the holster device.

FIG. 7 provides a front view of holster device 1 that includes the cradle 2, arcuate shaft 6, handle support 4 and attachment portion 8.

Figure 8:
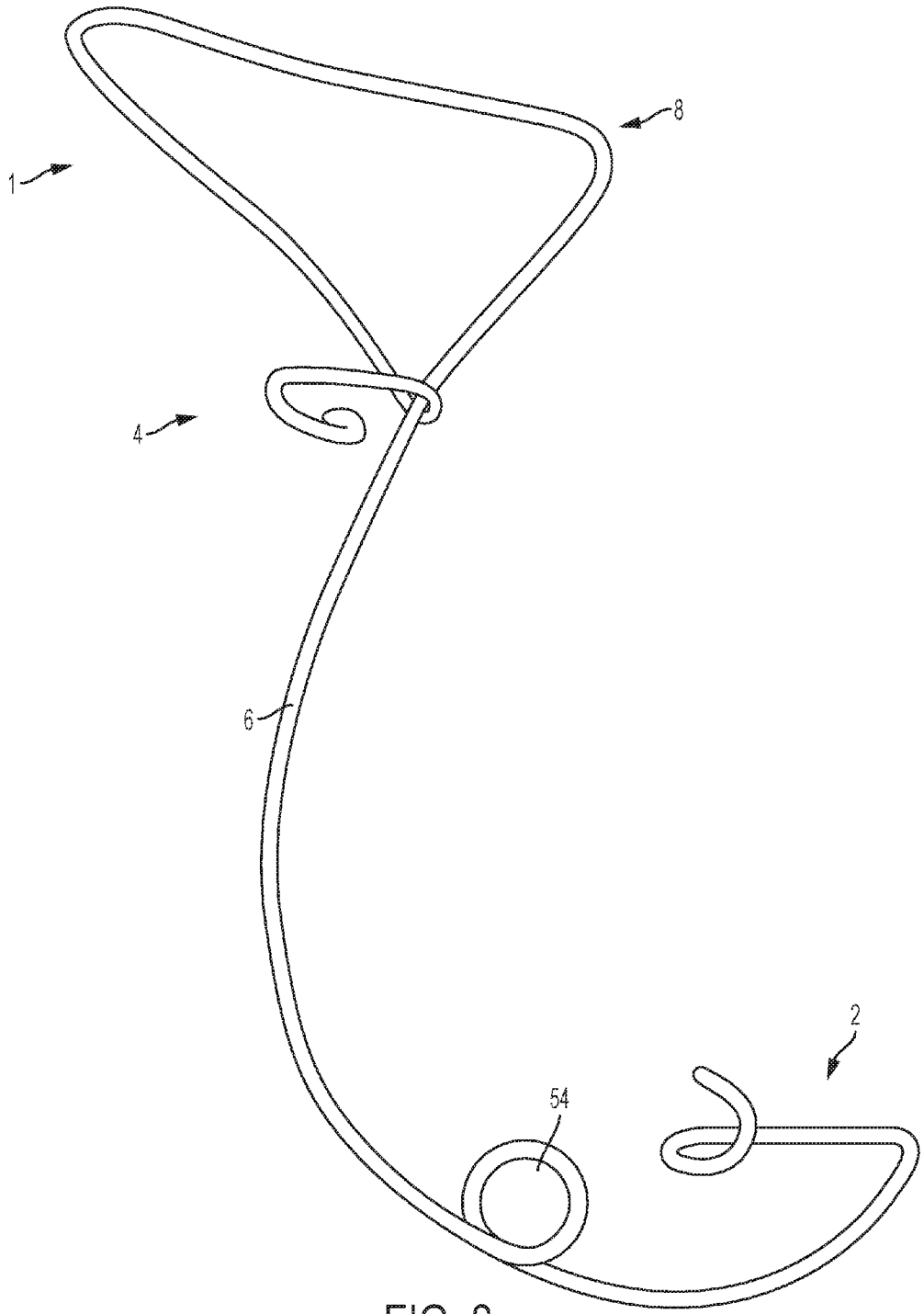
FIG. 8 is a perspective view of another embodiment of the holster device.
Figure 9:
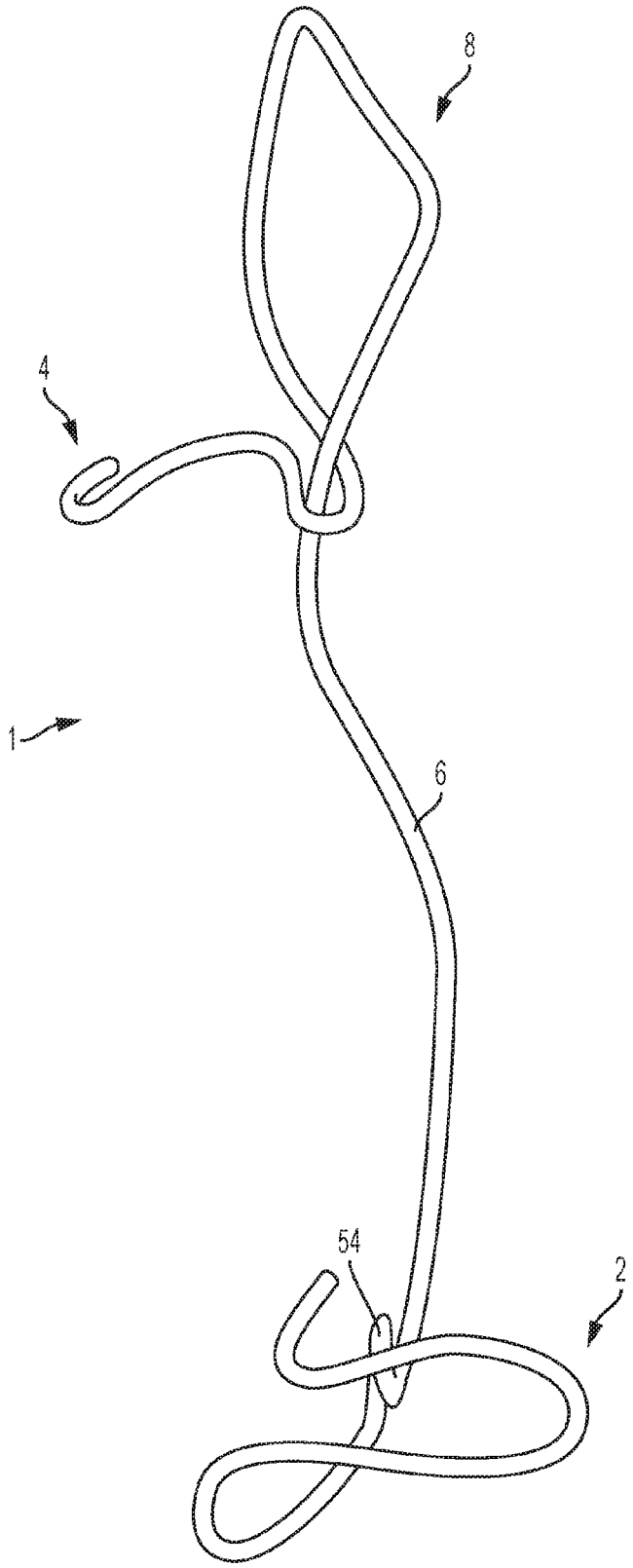
FIG. 9 is a front view of another embodiment of the holster device.

In another embodiment, holster device 1 can include a loop 54 that is formed contiguously with arcuate shaft 6, as shown in FIG. 8. FIG. 9 provides a front view of holster device 1 that includes loop 54. Loop 54 is shown in FIGS. 8 and 9 in the vicinity of the first end of the arcuate shaft 6, but the location of loop 54 can be shifted further towards either end of arcuate shaft 6.

Figure 10:
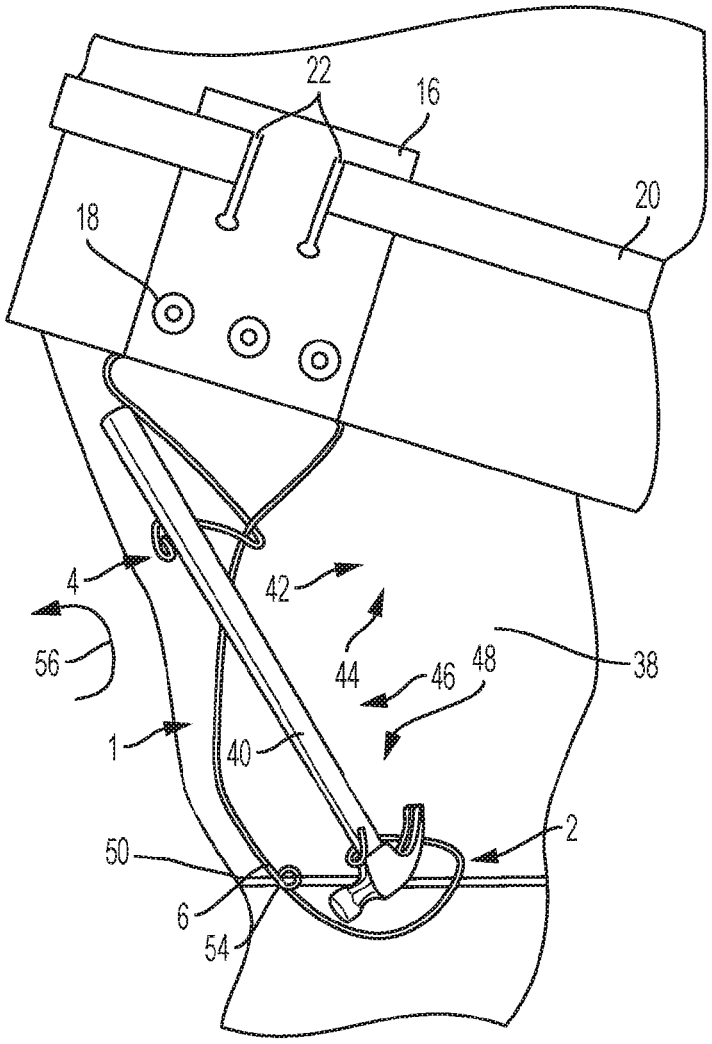
FIG. 10 is a perspective view of the other embodiment of the holster device.

As shown in FIG. 10, an optional strap 50 can pass through a portion of loop 54 to substantially maintain holster device 1 relatively fixed as compared to a user's leg. The optional strap can pass through, be tied, clipped or otherwise attached to holster device loop 54. Although loop 54 is shown as substantially circular, in other embodiments, loop 54 can be in an ellipse shape or any other suitable shape.

When the tool 40 is in the configuration shown in FIG. 10, the spring force of at least one of the arcuate shaft and the loop 54 provides a rotational force to the tool 40 along the directional arrow 56. This rotational force aids in maintaining the handle of the tool 40 in the cradle 4 during use.

In this embodiment, loop 54 can also impact a hammer as it moves from the position shown in FIG. 5 to the position shown in FIG. 6. This impact between loop 54 and the hammer can help in maintaining the hammer within the holster device 1.

The described embodiments and examples of the present disclosure are intended to be illustrative rather than restrictive, and are not intended to represent every embodiment or example of the present disclosure. While the fundamental novel features of the disclosure as applied to various specific embodiments thereof have been shown, described and pointed out, it will also be understood that various omissions, substitutions and changes in the form and details of the devices illustrated and in their operation, may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiment of the disclosure may be incorporated in any other disclosed or described or suggested form or embodiment as a general matter of design choice. Further, various modifications and variations can be made without departing from the spirit or scope of the disclosure as set forth in the following claims both literally and in equivalents recognized in law.

The invention claimed is:

1. A holster device comprising: an arcuate shaft, a first end of the arcuate shaft connected to a first end of a cradle, a second end of the arcuate shaft connected to a handle support and a central portion of the arcuate shaft formed between the first end of the arcuate shaft and the second end of the arcuate shaft; the cradle configured to contact a tool in a central portion of the cradle, wherein a central portion of the cradle is at an angle that is perpendicular to the first end of the arcuate shaft; the handle support configured to contact the tool in a central portion of the handle support, wherein the handle support loops around the arcuate shaft, wherein a central portion of the handle support is at an angle that is perpendicular to the central portion of the arcuate shaft, wherein all sections of the cradle are offset horizontally from the central portion of the arcuate shaft in a first direction, all sections of the handle support are offset horizontally from the central portion of the arcuate shaft in a second direction, and wherein the first direction is opposite the second direction, wherein the holster device comprises a triangular portion formed between the handle support and the central portion of the arcuate shaft, wherein the holster device is formed of a single piece of material; and a securing element configured to extend around a portion of the triangular portion, the securing element comprising at least one slit configured to receive a belt of a user.

2. The holster device of claim 1, further comprising a strap that is configured to extend about a user's leg and substantially maintain the holster device in a fixed position as compared to the user's leg.

3. The holster device of claim 1, wherein the holster device is configured to contain the tool and wherein the tool contacts at least one point of the central portion of the handle support and at least one point of the central portion of the cradle.

4. The holster device of claim 1, wherein the holster device is configured to contain the tool and wherein the tool contacts at least one point of the central portion of the handle support.

5. The holster device of claim 4, wherein the tool is contained between the central portion of the handle support and a second end of the cradle.

6. The holster device of claim 1, wherein the tool is a hammer.

7. The holster device of claim 1, wherein a loop is formed contiguously with the arcuate shaft in the vicinity of the first end of the arcuate shaft.

* * * * *